US005275863A

United States Patent [19]

Hanson

[11] Patent Number: 5,275,863

[45] Date of Patent: Jan. 4, 1994

[54] SEAL PROTECTOR FOR USE WITH STRAPPING AND METHOD FOR FORMING THE SEAL PROTECTOR

[75] Inventor: Charles R. Hanson, Appleton, Wis.

[73] Assignee: Laminations Corporation, Neenah, Wis.

[21] Appl. No.: 936,186

[22] Filed: Aug. 26, 1992

[51] Int. Cl.[5] ..... B65D 85/04; B32B 3/24

[52] U.S. Cl. ..... 428/136; 428/121; 428/124; 428/132; 428/133; 428/220; 428/338; 428/343; 428/535; 206/597; 206/586; 206/453; 24/16 R

[58] Field of Search ..... 428/121, 124, 132, 133, 428/136, 220, 338, 343, 535; 206/597, 586, 453; 24/16

[56] References Cited

U.S. PATENT DOCUMENTS

| | | | |
|---|---|---|---|
| 493,929 | 3/1893 | Holcomb | 428/132 |
| 3,362,867 | 1/1968 | Wilkins | 428/132 |
| 4,015,544 | 4/1977 | Szatkowski | 428/132 |

*Primary Examiner*—Ellis P. Robinson
*Assistant Examiner*—William P. Watkins, III
*Attorney, Agent, or Firm*—Wheeler Law Firm

[57] ABSTRACT

A seal protector for protecting material packed with metal strapping and a strapping seal from damage by the strapping seal and a method of forming the seal protector. The seal protector is formed from a piece of foldable crush resistant material into which an H-shaped cut is made. The cut forms flaps which fold over to contact the top surface of the material and are glued in that position, creating a seal protector with two different thickness levels and an opening.

8 Claims, 2 Drawing Sheets

SEAL PROTECTOR FOR USE WITH STRAPPING AND METHOD FOR FORMING THE SEAL PROTECTOR

BACKGROUND OF THE INVENTION

The present invention relates to the field of packaging. Specifically it relates to the packaging of steel with metal strapping and strapping seals.

To hold coils of steel together, the steel industry uses metal strapping which must necessarily be fastened together at its ends in order to form a solid band. For this purpose, a strapping seal is used. The steel closure process and the strapping seal can damage the coiled steel if the strapping seal contacts the coiled steel. Currently, in the industry, several products designed to elevate the strapping seal from the coiled steel exist. However, the inventor knows of no prior art that either teaches or shows the present invention.

FIG. 7 illustrates a prior art square piece of fiberboard having an opening at its center, and also having one set of its sides raised. This configuration does protect the steel in other packages when they are stacked atop or beneath the original package if the metal strapping crosses the thinner part of the board and the strapping seal is over the center opening.

For example, FIG. 8 illustrates a prior art square piece of fiberboard having a square die-cut opening at its center. The metal strapping is positioned so that the strapping seal crosses the fiber board over its center opening. This configuration provides protection of the coil of steel from the strapping seal. It does not protect the steel in other packages stacked beneath or atop the original package.

Both prior art forms use fiberboard ranging in thickness from 0.2 inch to 0.45 inch (0.51 to 1.14 centimeters). In both prior art forms, the material removed to form the center opening is discarded.

The present invention does not discard the material usually removed from the center of the seal protectors. Instead, the present invention uses a single H-shaped cut which does not fully cut out the center material. It folds the center material outwardly to form the second raised section of the invention. Because of this innovation, materials are fully used, which translates to cost savings. There is no waste.

Unlike the prior art, the center material folds outward to form a layer twice as thick as the original. Because of this, a material thinner than the prior art material will suffice to provide enough separation of the metal strapping and strapping seal from the coiled steel, to prevent damage to the coiled steel.

The present invention provides a cost effective product which will perform all of the functions of the previous art forms. It fully uses all material, cutting down on waste and cost.

Definition of Terms

For the purposes of clarity the terms given below shall be interpreted throughout the specification and the claims as having the following definitions. Should there be any contradiction between the meaning given a term herein and its common meaning that term shall be interpreted as having both meanings.

Protective panel: Any piece of material that is sufficiently incompressible to withstand pressure from metal strapping and which is flexible enough to be bent without breaking.

SUMMARY OF THE INVENTION

The present invention is a seal protector to be used to protect coiled steel from damage by a strapping seal, and a method of forming the seal protector. The invention is particularly effective because it serves two purposes while lowering the costs of material.

The seal protector comprises a protective panel into which a cut of predetermined shape is made. The cut creates flaps which each fold over along a bend line to contact the top surface of the original protective panel. The invention thus formed has an opening and two levels of protective panel material. The preferred protective panel material is fiberboard. The preferred cut is H-shaped and centrally located on the protective panel.

It is an objective of this invention to provide two separate functions for one specific structure. This structure will allow the invention to protect not only the coiled steel of the original package, but also the coiled steel in other packages depending on the orientation of the invention with respect to the metal strapping.

When the invention is oriented so that the metal strapping crosses the invention perpendicular to the bend lines, and the strapping seal crosses above the central opening, the invention will protect the coiled steel in the strapped package from damage by the strapping seal. When the invention is oriented so that the metal strapping crosses the invention parallel to the bend lines, and the strapping seal crosses above the central opening, the invention will protect both the coiled steel in the strapped package and the coiled steel in other packages stacked atop or beneath it. This is because the raised sides extend above the height to which the strapping seal extends.

The method of forming the seal protector requires a protective panel. The method essentially comprises: A first step in which the protective panel is cut to form flaps. A second step in which the flaps are folded over to contact the top surface of the protective panel. The flaps may then be secured in their positions by gluing, stapling, or other means.

These and other benefits of the present invention will become apparent from the following detailed description thereof taken in conjunction with accompanying drawings.

DESCRIPTION OF THE DRAWINGS

Referring to the drawings.

DETAILED DESCRIPTION

Although the disclosure hereof is detailed and exact to enable those skilled in the art to practice the invention, the physical embodiments herein disclosed merely exemplify the invention which may be embodiment in other specific structure. While the preferred embodiment has been described, the details may be changed without departing from the invention, which is defined by the claims.

Figure 1:
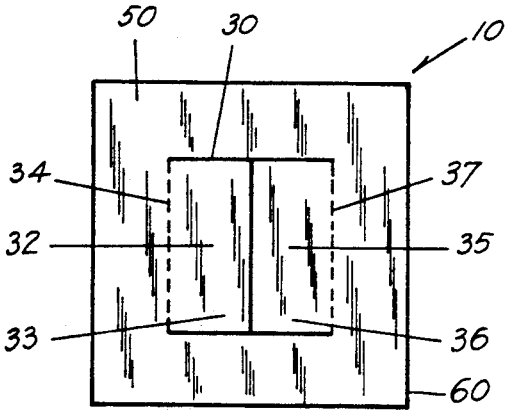
FIG. 1 illustrates a top view of the protective panel with an H-shaped die-cut.

Referring to FIG. 1, the invention 10 may be seen to be a square protective panel 60 ranging in size from 4 inches to 7 inches (10.2 to 17.8 centimeters) on a side, with a die-cut 30. Preferably, the protective panel 60 is made out of fiberboard and the die-cut 30 is H-shaped and centrally located. The H-shaped die-cut 30 creates flaps 32 and 35.

Figure 2:
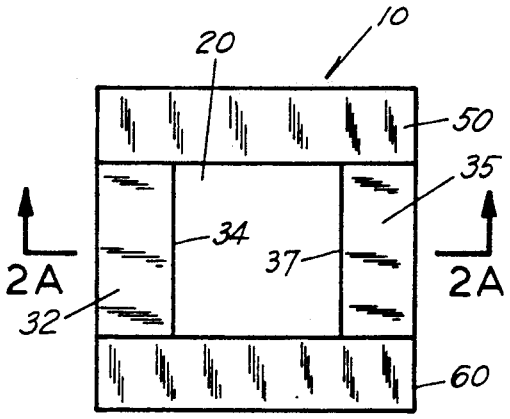
FIG. 2 illustrates a top view of the invention after the flaps have been folded over to contact the top surface.
Figure 2A:
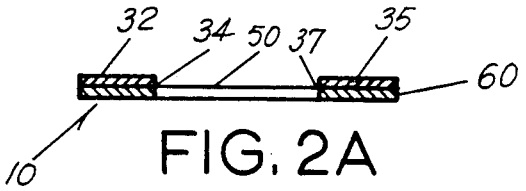
FIG. 2A illustrates a side view of the invention from line 2A—2A of FIG. 2.
Figure 3:
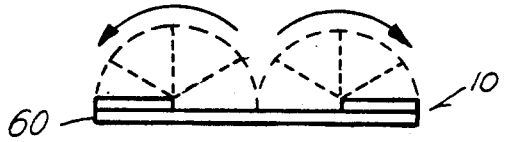
FIG. 3 illustrates the path that the flaps follow when folded.
Figure 4:
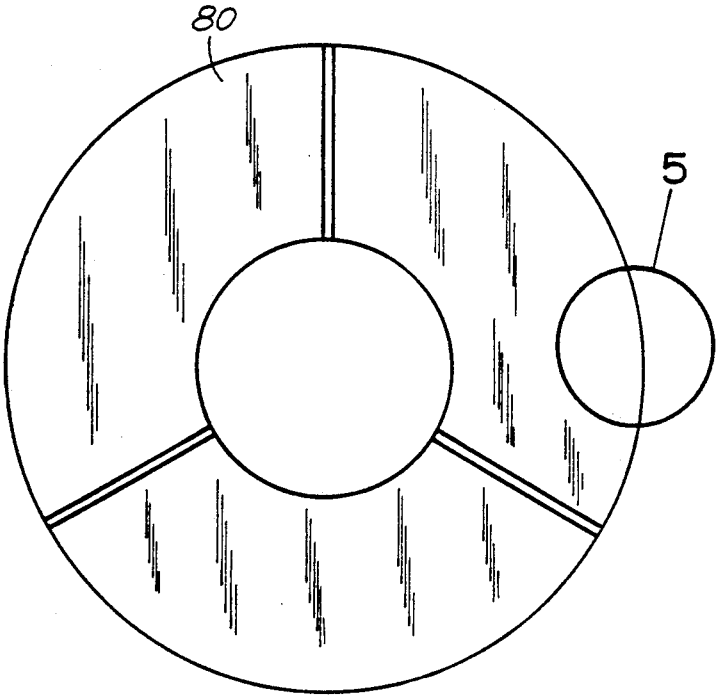
FIG. 4 illustrates the location of the invention on a coil of steel.

Flaps 32 and 35 have top surfaces 33 and 36. Referring to FIGS. 2, 2A, and 3 it may be seen that the flap 32 folds at a bend line 34, and folds over so that its top surface 33 contacts the top surface 50 of the protective panel 60, forming a layer that is twice as thick as the original protective panel 60. The flap 35 folds at a bend line 37, and folds over so that its top surface 36 contacts the top surface 50 of the protective panel 60. The flaps 32 and 35 may be fastened to the top surface 50 of the protective panel 60.

This folding of flaps 32 and 35 leaves a centrally located opening 20 in the protective panel 60. The invention 10 thus has two thickness levels and the central opening 20. Depending upon the orientation of the invention 10 with respect to a metal strapping 70, the invention 10 will protect a packed unit of steel 80 from a strapping seal 40, or will protect other similarly packed units stacked atop or beneath it.

Orienting the invention 10 so that the metal strapping 70 crosses the invention 10 parallel to the bend lines 34 and 37 results in protection of the packed unit of steel 80 from the strapping seal 40. In addition, the invention 10 protects other packed units of steel atop or beneath the original packed unit of steel 80. This is because the strapping seal 40 does not extend above the second thickness level of the invention 10. This is the preferred orientation.

Figure 6:
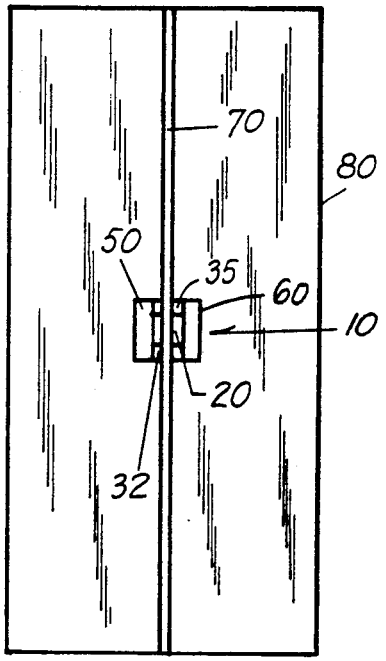
FIG. 6 illustrates the relative locations of metal strapping, strapping seal, and the invention to a coil of steel.
Figure 5:
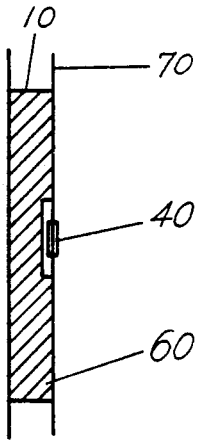
FIG. 5 illustrates a side view of the invention as it is located on a coil of steel.
Figure 8:
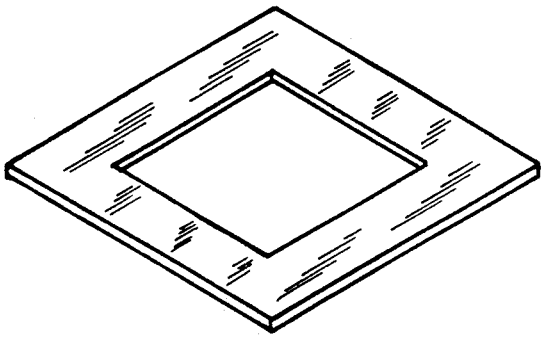
FIG. 8 PRIOR ART
FIG. 8 illustrates a perspective view of a prior art square piece of fiberboard having a central opening and one set of raised sides.
Figure 7:
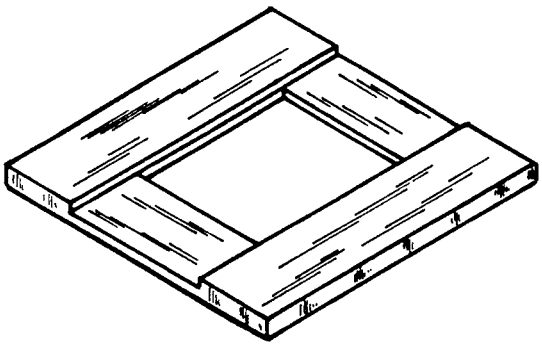
FIG. 7 PRIOR ART
FIG. 7 illustrates a perspective view of a prior art square piece of fiberboard with a die-cut center opening.

Referring to FIGS. 5 and 6, it may be seen that orienting the invention 10 so that the metal strapping 70 crosses the invention 10 perpendicular to the bend lines 34 and 37 results in protection of the packed unit of steel 80 from damage by the strapping seal 40. This is because the strapping seal 40 is held above the packed steel 80.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A seal protector, capable of protecting coiled steel secured with a metal strap, said metal strap having two ends, said ends being joined by a strapping seal, comprising:
   - a protector panel having a top surface and a single shaped cut;
   - said single shaped cut forming a first flap and a second flap, each flap having a top surface, a bend line, and each of said flaps being attached to said protective panel along its respective bend line;
   - each said flap being folded along its bend line;
   - said top surface of each said flap being secured in a position contacting said top surface of said protective panel to form an opening with reinforced edges capable of supporting said metal strap, wherein said opening is capable of being aligned with said strapping seal.

2. The seal protector of claim 1, in which the protective panel is square with side length of about 4 to 7 inches.

3. The seal protector of claim 1, in which the cut is H-shaped.

4. The seal protector of claim 1, in which the cut is centrally located on the protective panel.

5. The seal protector of claim 1, in which the protective panel is made of fiberboard.

6. The seal protector of claim 1, in which the seal protector comprises:
   - a square piece of fiberboard;
   - the piece of fiberboard having a top surface and an H-shaped cut centrally located on the protective panel;
   - the H-shaped cut forming said first flap and said second flap.

7. The seal protector of claim 1, further comprising:
   - fastening means for securing wherein said fastening means secures the top surface of each flap to the top surface of the protective panel.

8. The seal protector of claim 7, in which the fastening means is a glue.

* * * * *